US009410741B2

(12) United States Patent
Katefidis

(10) Patent No.: US 9,410,741 B2
(45) Date of Patent: Aug. 9, 2016

(54) DEVICE FOR CONTROLLING THE TEMPERATURE OF OBJECTS

(71) Applicant: EISENMANN AG, Böblingen (DE)

(72) Inventor: Apostolos Katefidis, Gärtringen (DE)

(73) Assignee: EISENMANN AG, Boeblingen (DE)

( * ) Notice: Subject to any disclaimer, the term of this patent is extended or adjusted under 35 U.S.C. 154(b) by 121 days.

(21) Appl. No.: 14/360,331

(22) PCT Filed: Nov. 10, 2012

(86) PCT No.: PCT/EP2012/004677

§ 371 (c)(1),
(2) Date: May 23, 2014

(87) PCT Pub. No.: WO2013/075793

PCT Pub. Date: May 30, 2013

(65) Prior Publication Data

US 2014/0352169 A1 Dec. 4, 2014

(30) Foreign Application Priority Data

Nov. 25, 2011 (DE) ..... 10 2011 119 436

(51) Int. Cl.
*F26B 21/06* (2006.01)
*F26B 23/02* (2006.01)
(Continued)

(52) U.S. Cl.
CPC ..... *F26B 23/02* (2013.01); *F23C 9/006* (2013.01); *F23D 14/24* (2013.01); *F23G 7/066* (2013.01); *F26B 15/10* (2013.01); *F26B 23/022* (2013.01); *F26B 2210/12* (2013.01)

(58) Field of Classification Search
CPC ..... F26B 21/00; F26B 21/06; F26B 21/03; F26B 33/00; F26B 33/02; F24H 3/00; F24H 3/02
USPC ..... 34/90, 104, 105, 202, 210, 218; 126/110 A, 110 R; 432/21, 176
See application file for complete search history.

(56) References Cited

U.S. PATENT DOCUMENTS 2,391,195 A * 12/1945 Ross ..... F26B 3/283 34/219
2,472,293 A * 6/1949 Groven ..... F26B 3/283 219/388

(Continued)

FOREIGN PATENT DOCUMENTS

DE 25 38 413 A1 3/1977
DE 37 17 320 C1 7/1988

(Continued)

*Primary Examiner* — Stephen M Gravini
(74) *Attorney, Agent, or Firm* — Factor Intellectual Property Law Group, Ltd.

(57) ABSTRACT

A temperature-controlling tunnel is accommodated in a housing and defines at least one tunnel portion, which comprises at least one air outlet and at least one air inlet. The tunnel portion is paired with a heater assembly in which a hot primary gas can be generated by means of a burner unit. The hot primary gas can be conducted into a heat exchanger of the heater assembly, and tunnel air can be heated in the heat exchanger by means of the hot primary gas and fed back to the tunnel portion via the at least one air inlet in a circuit as a circulating air flow. A burner supply device is provided by means of which exhaust air from the tunnel portion can be fed to the burner unit of the heater assembly as a burner air flow in order to generate the primary gas.

10 Claims, 3 Drawing Sheets

(51) Int. Cl.

| | |
|---|---|
| ***F23C 9/00*** | (2006.01) |
| ***F23D 14/24*** | (2006.01) |
| ***F23G 7/06*** | (2006.01) |
| ***F26B 15/10*** | (2006.01) |

(56) References Cited

U.S. PATENT DOCUMENTS 3,942,264 A * 3/1976 Zenkner ..... B01D 53/34 34/514
4,255,132 A * 3/1981 Carthew ..... F23G 5/46 432/2
4,416,068 A * 11/1983 Nilsson ..... B05D 3/0263 118/642
4,635,381 A * 1/1987 Hubbert ..... F26B 3/283 34/225
4,656,758 A * 4/1987 Nakayama ..... F26B 3/305 34/212
4,670,994 A 6/1987 Takata et al.
4,761,894 A * 8/1988 Hamasaki ..... F26B 3/305 118/58
4,771,552 A * 9/1988 Morioka ..... F26B 15/12 34/222
5,113,600 A * 5/1992 Telchuk ..... B05B 15/1207 34/218
5,263,265 A * 11/1993 Melgaard ..... B29C 35/06 34/421
5,568,692 A * 10/1996 Crompton ..... F26B 3/283 34/270
5,657,555 A * 8/1997 Milojevic ..... F26B 3/283 34/271
5,661,912 A * 9/1997 Bhatnagar ..... F26B 3/283 34/267
5,689,899 A * 11/1997 Szenker ..... F26B 3/283 34/270
5,868,562 A * 2/1999 Watanabe ..... B05B 15/1222 432/152
6,898,868 B2 * 5/2005 Vermeulen ..... B65B 53/066 219/427
7,360,534 B2 * 4/2008 Krupp ..... B05B 15/1222 126/110 A
8,519,307 B2 * 8/2013 Schumacher ..... F26B 3/283 219/388
8,756,827 B1 * 6/2014 Calabro ..... B05B 15/1222 118/312
8,826,565 B2 * 9/2014 Hahn ..... F26B 21/12 118/326
8,832,964 B2 * 9/2014 Foxen ..... C09F 3/00 144/364
2011/0023314 A1 2/2011 Schwerer et al.
2014/0352169 A1 * 12/2014 Katefidis ..... F23C 9/006 34/666
2015/0121720 A1 * 5/2015 Wieland ..... F26B 15/14 34/493

FOREIGN PATENT DOCUMENTS

DE WO 2006010579 A1 * 2/2006 ..... F23G 7/066
DE WO 2008017345 A1 * 2/2008 ..... B01D 46/0057
DE 102006058696 A1 * 8/2008 ..... F23G 7/068
DE EP 2071260 A1 * 6/2009 ..... F26B 3/28
DE 10 2008 012 792 A1 9/2009
DE 102008026317 A1 * 12/2009 ..... B65G 49/0459
DE 10 2010 006 550 A1 8/2011
DE 102012207312 A1 * 11/2013 ..... F26B 15/14
DE WO 2013164285 A1 * 11/2013 ..... F26B 15/14
EP 2 295 909 A1 3/2011

* cited by examiner

DEVICE FOR CONTROLLING THE TEMPERATURE OF OBJECTS

RELATED APPLICATIONS

This application is a national phase of International Patent Application No. PCT/EP2012/004677, filed Nov. 10, 2012, which claims the filing benefit of German Patent Application No. 10 2011 119 436.7, filed Nov. 25, 2011, the contents of both of which are incorporated herein by reference.

FIELD OF THE INVENTION

The invention relates to a device for controlling the temperature of objects, in particular for drying coated motor vehicle bodies, having a) a temperature-controlling tunnel which is accommodated in a housing and defines at least one tunnel portion which comprises at least one air outlet and at least one air inlet;

wherein b) there is associated with the tunnel portion a heater assembly in which a hot primary gas can be generated by means of a burner unit;

c) the hot primary gas can be conducted into a heat exchanger of the heater assembly, in which tunnel air can be heated by hot primary gas, which tunnel air can be fed to the tunnel portion again in a circuit via the at least one air inlet as a circulating air stream.

BACKGROUND OF THE INVENTION

The invention is described below using the example of motor vehicle bodies as objects, but the invention relates also to devices for other objects whose temperature must be controlled in a production process. When the term "temperature control" is used here, it means the inducement of a specific temperature of the object that the object does not initially possess. It can be a temperature increase or a temperature reduction. "Temperature-controlled air" is understood as meaning air that has the required temperature for controlling the temperature of the object.

A frequent case of the temperature control, namely the heating, of motor vehicle bodies in the automotive industry is the operation of drying wet motor vehicle bodies or of drying the coating of a motor vehicle body, whether that be a paint or an adhesive or the like. Wet objects other than motor vehicle bodies or the coating of other objects can correspondingly be dried. The detailed description of the invention which is given below is made using the example of such a drier for motor vehicle bodies.

When the term "drying" is used here, it means any operations in which the coating of the motor vehicle body, in particular a paint, can be made to cure, whether that be by the expulsion of solvents or by the crosslinking of the coating substance.

Devices of the type mentioned at the beginning that are known on the market are used for drying freshly painted motor vehicle bodies and are heated, inter alia, by extracting air from tunnel portions that are short compared with the overall length of the drying tunnel, heating it in a heater assembly by means of a heat exchanger, and feeding it to the corresponding tunnel portion again in a circuit.

In the drying of freshly painted motor vehicle bodies, the air removed from the tunnel portion is loaded mainly with solvent, which is released in the drying operation. This air additionally contains coating constituents which are released during the drying of the motor vehicle body; nevertheless, for the sake of simplicity, reference will be made only to waste air below.

In known devices, the burner air necessary for operating the burner unit is removed from the surroundings via a separate air compressor fan. Accordingly, the burner air must be heated from ambient temperature to the burner temperature and is removed from the surroundings as clean air, which is contaminated during use and can optionally be purified before being returned to the surroundings.

SUMMARY OF THE INVENTION

An object of the invention is to provide a device of the type mentioned at the beginning which offers an alternative to known devices and in particular has a better energy balance.

The object may be achieved in a device of the type mentioned at the beginning in that d) a burner supply device is provided, by means of which waste air from the tunnel portion can be fed to the burner unit of the heater assembly as a burner air stream for generating the primary gas to the burner unit.

According to the invention, therefore, waste air from the tunnel portion is used to generate the hot primary gas flow by means of which the circulating air is heated. Unlike known burner units, clean ambient air is thus not used as burner air; instead, already contaminated waste air from the temperature-controlling tunnel is used for that purpose. This waste air is already hotter than the ambient air and therefore does not have to be heated in the burner unit to the same extent as fresh ambient air. The overall energy balance of the device is thereby improved.

It is particularly advantageous if the heater assembly is so configured that the burner air is guided to the burner unit after the burner air has flowed through the heat exchanger and been heated therein. In this manner, the burner air is at a high temperature when it reaches the burner unit, so that the heating of the burner air that is necessary there is again reduced.

It is an advantage if the heater assembly comprises a distributor device by means of which tunnel air from the tunnel portion can be divided into the circulating air stream and the burner air stream.

It is particularly efficient if the distributor device is arranged downstream of the heat exchanger, so that the tunnel air heated therein is divided into the circulating air stream and the burner air stream.

If the volume flows of the circulating air stream and of the burner air stream are adjustable by means of the distributor device, the device can be adapted in a simple manner to different objects whose temperature is to be controlled. To that end, for example, a regulating valve can be present in the flow path.

It is particularly advantageous if the burner unit is a thermal after-burning device. In this case, the after-burning, and thus the disposal of the solvent-containing waste air, is accordingly integrated into the heater assembly and only part of the air removed from the tunnel portion is fed back into the tunnel portion again as circulating air.

It has been found to be particularly successful if the burner unit is a gas burner, in particular a planar burner.

It is advantageous if means are provided by which the burner air can be divided into primary air and secondary air, the primary air being mixed directly with the burnable gas. The secondary air can then be used for other measures.

It is particularly advantageous if secondary air is mixed by means of flue gas recycling with flue gases generated by the burner unit, and a secondary air/flue gas mixture so obtained is fed to the combustion gases of primary air and burnable gas. In this manner, the amount of oxygen available for combustion can be adjusted via the flue gas admixture. This will be discussed in greater detail below.

It is to be understood that the aspects and objects of the present invention described above may be combinable and that other advantages and aspects of the present invention will become apparent upon reading the following description of the drawings and detailed description of the invention.

BRIEF DESCRIPTION OF THE DRAWINGS

An exemplary embodiment of the invention will be described in greater detail below with reference to the drawings, in which.

DETAILED DESCRIPTION OF THE PRESENT INVENTION

Figure 1:
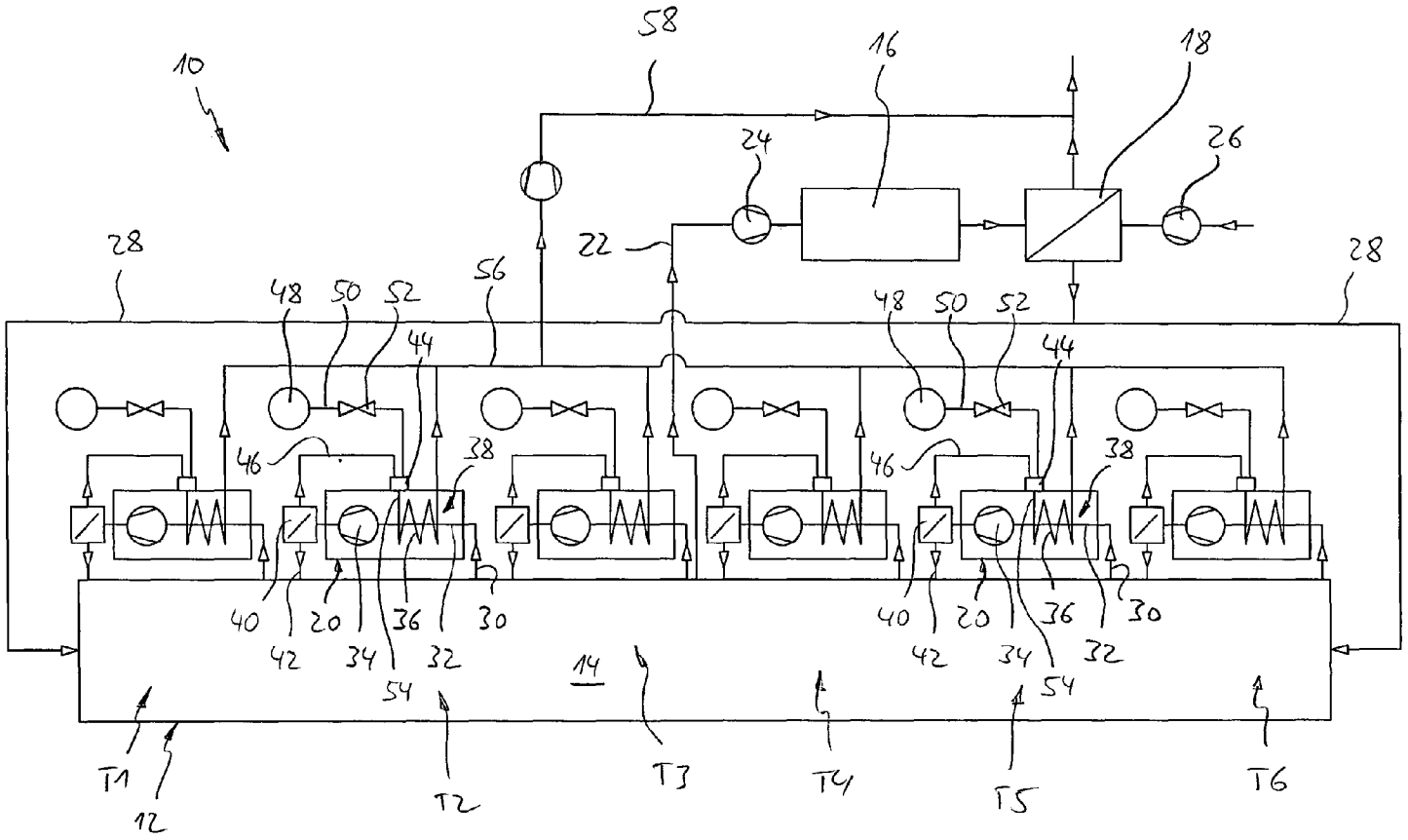
FIG. 1 shows a schematic representation of a drier with a thermal after-burning device and a plurality of heater assemblies.

While this invention is susceptible of embodiment in many different forms, there is shown in the drawings and will herein be described in detail one or more embodiments with the understanding that the present disclosure is to be considered as an exemplification of the principles of the invention and is not intended to limit the invention to the embodiments illustrated.

In FIG. 1, a drier 10 is shown schematically as an example of a device for controlling the temperature of objects. The drier 10 comprises a heat-insulated drier housing 12 in which a drying tunnel 14 is accommodated as the temperature-controlling tunnel, through which motor vehicle bodies (not shown) are conveyed continuously. To that end, the drier 10 comprises a conveyor system known per se for the motor vehicle bodies, which is likewise not shown for the sake of clarity.

Heated air is fed to the drying tunnel 14 in order to dry the motor vehicle bodies, or a coating applied thereto. When the term "drying" is used here, it means any operations in which the coating of the motor vehicle body, in particular a paint, can be made to cure, whether that be by the expulsion of solvents or by the crosslinking of the coating substance.

The drier 10 comprises a thermal after-burning device 16 and a waste air heat exchanger 18 arranged downstream thereof, as well as a plurality of heater assemblies 20 of identical construction, which will be discussed in greater detail below.

The thermal after-burning device 16 is a gas burner to which waste air from the drying tunnel 14 is fed via a waste air line 22 by means of a waste air fan 24. In the after-burning device 16, burnable gas is added to the waste air from the drying tunnel 14, and the waste air/gas mixture so obtained is burnt, whereby the noxious substances contained in the waste air are rendered harmless.

The waste air treated and freed of noxious substances by heating in the thermal after-burning device 16 then passes into the waste air heat exchanger 18, in which fresh air fed to the waste air heat exchanger 18 by means of a fresh air fan 26 is heated by the heated waste air. This heated fresh air is then conveyed from the waste air heat exchanger 18 via fresh air feed lines 28 into the drying tunnel 14, preferably via the inlet and outlet region thereof. The waste air that has flowed through the waste air heat exchanger 18 is discharged via the top.

The temperature necessary for drying is maintained in the drying tunnel 14 by the heater assemblies 20, which are arranged in the form of compact gas burner units along the drying tunnel 14 and form a burner system. Associated with each heater assembly 20 is a tunnel portion T defined by the drying tunnel 14, the drying tunnel 14 having a plurality of such tunnel portions T. In the present exemplary embodiment, six tunnel portions T1 to T6 and six associated heater assemblies 20 are shown by way of example. The tunnel portions T1 to T6 are not structurally separate from one another in the present exemplary embodiment.

Tunnel air is fed to each of the heater assemblies 20 through an air outlet of the associated tunnel portion T, which air outlet is in the form of an outlet line 30. The outlet line 30 merges into a useful air line 32, in which a conveyor fan 34 is arranged.

The useful air line 32 in turn leads through a heat exchanger coil 36 of a heat exchanger 38 to a distributor device 40, which divides the useful air stream coming from the useful air line 32 into a circulating air stream and a waste air stream, after the useful air has passed through the heat exchanger 38.

The circulating air is blown into the associated tunnel portion T of the drying tunnel 14 again through an air outlet in the form of an inlet line 42. The waste air serves as burner air for a burner unit in the form of a gas burner 44, to which the waste air is fed as the burner air stream via a burner air line 46. A planar burner, as is known per se, has been found to be suitable in practice as the gas burner 44.

The distributor device 40 and the burner air line 46 thus form a burner supply device via which waste air from the associated tunnel portion is fed to the gas burner 44 as the burner air stream in order to generate the hot primary gas.

The required burnable gas is fed to the gas burner 44 from a burnable gas source 48 via a burnable gas line 50. The volume flow of the burnable gas can be adjusted by means of a valve 52 that is arranged in the burnable gas line 50. In the gas burner 44, the solvents in the waste air are burnt as far as possible, hot combustion gases forming as primary gas. These hot combustion gases are fed via a feed line 54 to the heat exchanger 38, where they heat the solvent-containing useful air flowing through its heat exchanger coil 36, the useful air at the temperature achieved therein consequently flowing into the gas burner 44 as solvent-containing burner air.

After flowing through the heat exchanger coil 36 of the heat exchanger 38, the hot combustion gases of the gas burner 44 are discharged via a waste gas line 56, which is connected as a collecting line to the heat exchanger coils 36 of all the heater assemblies 20 and merges at a junction into a waste air line 58, via which the waste gases, like the waste gases of the after-burning device 16, are discharged via the top.

The primary gas of the gas burner 44 accordingly heats in the heat exchanger 38 both circulating air, which is fed to the associated tunnel portion T again in a circuit via the air inlet line 42, and waste air, which is fed to the gas burner 44 as burner air.

The distributor device 40 of a heater assembly 20 can be adjustable so that it is possible to adjust the volume flows that are fed as circulating air into the drying tunnel 14 again and as burner air to the gas burner 44. The proportion of tunnel air branched off as burner air is of the order of magnitude of about 1% of the tunnel air that flows from the tunnel portion T of the associated heater assembly 20 into the outlet line 30.

Figure 2:
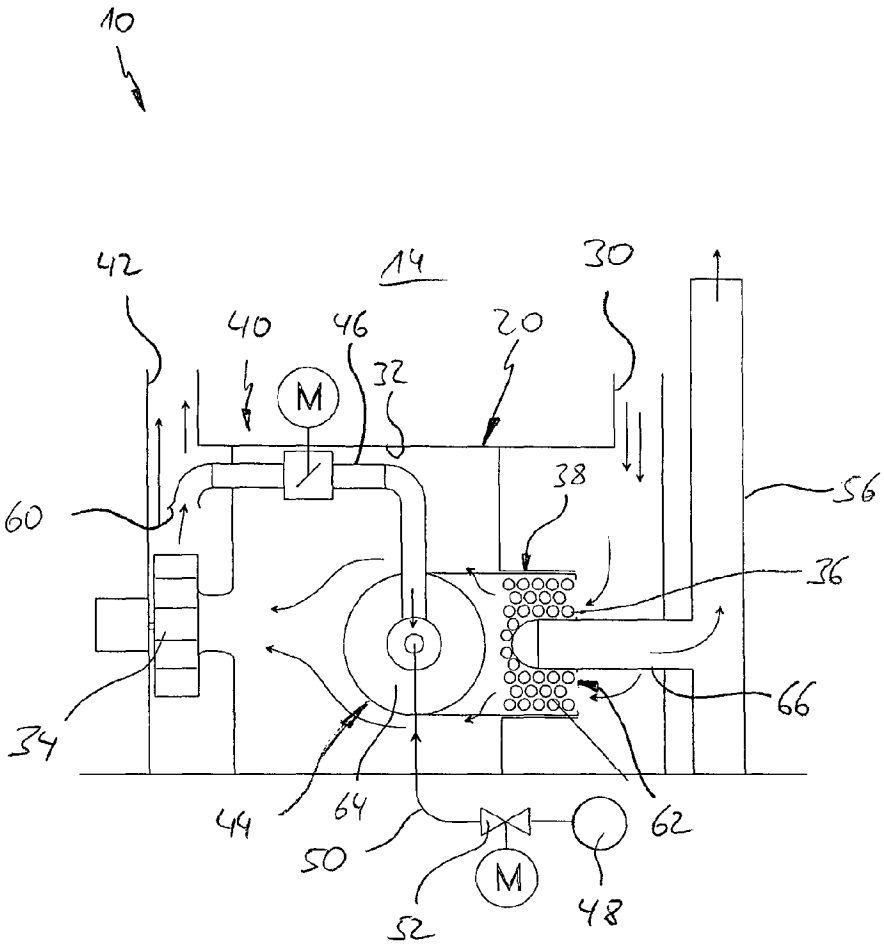
FIG. 2 shows a more detailed view of a heater assembly.

As can be seen in FIG. 2, the distributor device 40 can be formed, for example, by arranging an inlet opening 60 of the burner air line 46 in the inlet line 42 leading to the drying tunnel 14 so that part of the useful air coming from the heat exchanger 38 through the useful air line 32 flows into the burner air line 46, while the other part enters the inlet line 32 and, via the inlet line 32, the drying tunnel 14.

As is likewise shown in FIG. 2, the heat exchanger coil 36 of the heat exchanger 38 can be in the form of a tube bundle 62 through which there flow the hot combustion gases of the gas burner 44, the combustion chamber of which is designated 64. In the representation according to FIG. 2, the hot combustion gases from the combustion chamber 38 enter the individual tubes of the tube bundle 62, which are not provided individually with a reference numeral, behind the plane of the drawing, flow through the tubes in front of the plane of the drawing and there enter the waste gas line 56 via, a collecting line 66.

Figure 3:
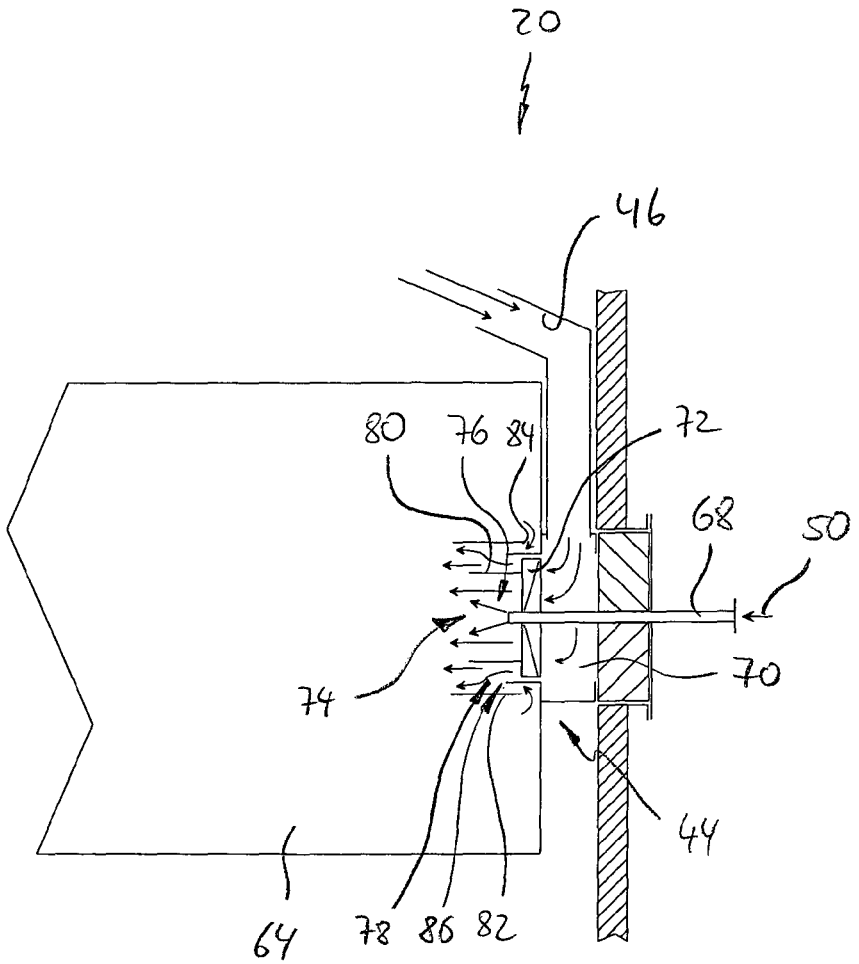
FIG. 3 shows schematically a section of the heater assembly in the region of a gas burner present there.

The guiding of air and gas in the gas burner 44 is shown schematically in FIG. 3, where 68 designates a gas nozzle which is fed with burnable gas via the burnable gas line 50, which is indicated in FIG. 3 by an arrow, and blows it into the combustion chamber 64.

The burner air passes via the burner air line 46 first into a combustion chamber pre-space 70, from where it flows via a swirl plate 72 into a mixing zone 74 of the gas burner 44, which surrounds the delivery opening of the gas nozzle 68. By means of the swirl plate 72, the burner air is swirled before it enters the mixing zone 74, as a result of which swirls and turbulences are purposively generated in order to assist with the mixing of the burner air and the burnable gas. To that end, the swirl plate 72 can include, for example, flow channels or paddle elements, by means of which the burner air is swirled as it flows through the swirl plate 72.

The mixing zone 74 in turn comprises a cylindrical core region 76 around the gas nozzle 68 and an annular space 78 which surrounds the core region 76 coaxially, to which end a cylindrical inner wall 80 and a cylindrical outer wall 82 are present in the mixing zone 74. The burner air which has flowed through the swirl plate 70 is divided by the inner wall 80. Part of the burner air thus passes as primary air into the core region 76, while the other part flows as secondary air into the annular space 78.

The annular space 78 additionally communicates with the combustion chamber 64 of the gas burner 44 via an annular gap 84. Overall, flue gas recycling in the form of an annular nozzle 86 is formed in the annular space 78 according to the Venturi principle. The flowing secondary air creates a suction effect at the annular gap 84, which causes flue gas to be drawn from the combustion chamber 64 of the gas burner 44 into the annular space 78, where the flue gas mixes with the secondary gas coming from the swirl plate 70.

By the removal of waste air from the drying tunnel 14 via the outlet lines 30 and division into a useful air stream and a burner air stream, part of the air circulated in the drying tunnel 14 is accordingly heated considerably in the gas burners 44 of the heater assemblies 20 on combustion. As a result, neutralisation of the noxious substances which have accumulated in the waste air is already ensured in the heater assemblies 20. The gas burner 44 is accordingly a thermal after-burning device.

Because the burner air is heated by the heat exchanger 38 before it reaches the gas burner 44, burnable gas can be saved at the respective gas burner 44. This saving can amount to up to 15%, relative to gas burners whose burner air is not heated or is heated to a lesser degree. On account of the warmer burner air, the flame temperature increases, resulting in an improvement in the efficiency of the gas burner 44. Although this is generally at the expense of higher values in terms of nitrogen oxides $NO_x$, these can be reduced again by measures known from the prior art.

Alternatively to the known measures, the reduction in the nitrogen oxides NO is achieved in the gas burner 44 by the division of the mixing zone 74 into the core region 76 and the annular space 78 with the flue gas recycling 86. The oxygen content in the secondary air/flue gas mixture which forms in the annular space 78 is lower than the oxygen content of the secondary air prior to mixing. In addition, the secondary air is heated and the recycled flue gas is cooled by the flue gas recycling; the secondary air/flue gas mixture has a corresponding mean temperature.

Combustion in the core region 76 first takes place substoichiometrically, so that, for example, not all the carbon monoxide CO that is initially produced oxidises to carbon dioxide $CO_2$ with the oxygen $O_2$ supplied by the primary air, and carbon monoxide CO is still present in the combustion gases that form.

The secondary air/flue gas mixture having a reduced oxygen content passes, after flowing through the annular space 78, into the edge region of the core region 76, where it mixes with the combustion gases formed in the core region 76 from primary air and burnable gas. The secondary air/flue gas mixture serves as the oxygen donor for the carbon monoxide CO that is still present, which is now oxidised completely to $CO_2$ at a relatively low temperature, only small amounts of nitrogen monoxide NO being formed, so that only small amounts of nitrogen oxides $NO_x$ are consequently also produced. Overall, with this burner configuration, excellent values in terms of carbon monoxide CO and nitrogen oxides NO are achieved with an oxygen content of not more than 3%.

Because a portion of the waste air removed from the drying tunnel 14 is used as combustion air for the gas burners 44, the proportion of tunnel air that must be fed as waste air to the after-burning device 16 is reduced by the corresponding proportion. As a result, the contribution made by after-burning is lower and the gas consumption for the after-burning device can be reduced overall.

Overall, the proportion of waste gases discharged to the atmosphere via the top is also reduced.

It is to be understood that additional embodiments of the present invention described herein may be contemplated by one of ordinary skill in the art and that the scope of the present invention is not limited to the embodiments disclosed. While specific embodiments of the present invention have been illustrated and described, numerous modifications come to mind without significantly departing from the spirit of the invention, and the scope of protection is only limited by the scope of the accompanying claims.

The invention claimed is:

1. Device for controlling the temperature of objects, in particular for drying coated motor vehicle bodies comprising:

a) a temperature-controlling tunnel which is accommodated in a housing and defines at least one tunnel portion which comprises at least one air outlet and at least one air inlet;

wherein b) there is associated with the tunnel portion a heater assembly in which a hot primary gas can be generated by means of a burner unit;

c) the hot primary gas can be conducted into a heat exchanger of the heater assembly, in which tunnel air can be heated by hot primary gas, which tunnel air can be fed to the tunnel portion again in a circuit via the at least one air inlet as a circulating air stream, wherein d) a burner supply device, by means of which waste air from the tunnel portion can be fed to the burner unit of the heater assembly as a burner air stream for generating the primary gas to the burner unit.

2. Device for controlling the temperature of objects according to claim 1, wherein the heater assembly is so configured that the burner air is guided to the burner unit after the burner air has flowed through the heat exchanger and has been heated therein.

3. Device for controlling the temperature of objects according to claim 1 wherein the heater assembly comprises a distributor device by means of which tunnel air from the tunnel portion can be divided into the circulating air stream and the burner air stream.

4. Device for controlling the temperature of objects according to claim 3, wherein the distributor device is arranged downstream of the heat exchanger so that the tunnel air heated therein is divided into the circulating air stream and the burner air stream.

5. Device for controlling the temperature of objects according to claim 3, wherein a volume flows of the circulating air stream and of the burner air stream can be adjusted by means of the distributor device.

6. Device for controlling the temperature of objects according to claim 1, wherein the burner unit is a thermal afterburning device.

7. Device for controlling the temperature of objects according to claim 1, wherein the burner unit is a gas burner.

8. Device for controlling the temperature of objects according to claim 7, wherein walls are provided by which the burner air can be divided into primary air and secondary air, the primary air being mixed directly with the burnable gas.

9. Device for controlling the temperature of objects according to claim 8, wherein secondary air is mixed by means of flue gas recycling with flue gases generated by the burner unit, and a secondary air/flue gas mixture so obtained is fed to the combustion gases of primary air and burnable gas.

10. Device for controlling the temperature of objects according to claim 1, wherein the burner unit is a planar burner.

* * * * *